United States Patent [19]

Palmieri et al.

[11] 3,992,855

[45] Nov. 23, 1976

[54] AUTOMATIC WRAPPING MACHINES

[75] Inventors: Angelo Palmieri; Sandro Salicini, both of Bologna, Italy

[73] Assignee: Carle & Montanari S.p.A., Italy

[22] Filed: Dec. 31, 1975

[21] Appl. No.: 645,592

[30] Foreign Application Priority Data

Jan. 3, 1975 . Italy ..... 12403/75

[52] U.S. Cl. ..... 53/209; 53/234; 198/480; 198/484; 198/797; 198/653; 198/803

[51] Int. Cl.[2] ..... B65B 11/36

[58] Field of Search ..... 53/209, 225, 233, 234; 198/25, 209, 211.

[56] References Cited

UNITED STATES PATENTS

| | | | |
|---|---|---|---|
| 2,603,048 | 7/1952 | Sandberg | 53/225 |
| 3,039,606 | 6/1962 | Dearsley | 198/25 X |
| 3,093,234 | 6/1963 | Janssen, Jr. | 198/25 X |
| 3,135,373 | 6/1964 | Scarf | 198/25 |
| 3,338,026 | 8/1967 | Billi | 53/209 X |
| 3,789,576 | 2/1974 | Giles | 53/234 |
| 3,797,198 | 3/1974 | Fukuzaki | 53/209 |

*Primary Examiner*—Travis S. McGehee
*Assistant Examiner*—John Sipos
*Attorney, Agent, or Firm*—Pollock, Vande Sande & Priddy

[57] ABSTRACT

An apparatus for transferring soap bars to be wrapped from a lower feed conveyor to an upper wrapping conveyor, with the purpose of avoiding any scratches or dents on the freshly manufactured soap bars due to sliding against fixed parts. The apparatus comprises, arranged on the lower conveyor, a plurality of containers open at the top and presenting in plan a cross-like section, so as to leave free the corner portions of the soap bars carried thereby. The soap bars are taken off from the containers of said lower conveyor by composite cradles arranged on a rotating turntable conveyor having its axis of rotation horizontal and orthogonal with respect to the lower conveyor. The composite cradles consist of two cradle halves which are opened during their descent towards the lower conveyor, so as to pass through this conveyor and position themselves beneath a soap bar-carrying container. At this stage, the composite cradles are closed, and move upwardly so as to lift the product by supporting it by its corner portions. During the lifting, a wrapper is positioned onto the soap bar, which is then taken away from the composite cradle by suitable grippers provided with vertical and horizontal movement, which grippers insert the soap bar and wrapper inside the conveyor which leads to the final wrapping station.

6 Claims, 8 Drawing Figures

A
B
C
D
D1
E
F
F1
F2
Z
Z1
Z2
S
1
2
3
4
5
6
7
14
25
125
34
35
101
103
201
203
303

AUTOMATIC WRAPPING MACHINES

FIELD OF THE INVENTION

The invention relates to improvements in wrapping machines, particularly adapted for cakes or bars of soap, or prismatic bodies in general, for the purpose of avoiding as much as possible any relative movements between the product to be wrapped and the devices which handle same, and therefore to avoid scratches or dents in the product itself. More particularly, the invention relates to those automatic machines in which the soap bars are fed by suitable means in the equispaced and suitably positioned containers of a horizontal rectilinear conveyor and in which an intermediate turntable conveyor is provided in order to cyclically take the soap bars out of the said containers and feed them together with the wrapper sheets to an overlying conveyor which inserts the whole (soap bar and wrapper) inside guides which define and close the wrapping.

The improvements according to the invention are particularly directed to the intermediate or "connection" turntable conveyor in order to avoid, as it happens presently, that during the transfer of the product from the feeding conveyor to the last wrapping conveyor, sliding of the product against fixed guides or subjection of the product to relative movement with respect to the means by which it is handled.

BRIEF DESCRIPTION OF THE DRAWINGS

The advantages and characteristic features which derive from the said improvements will appear from the following description of a preferred embodiment of the invention illustrated on the annexed four sheets of drawings, in which.

DESCRIPTION AND OPERATION OF THE PREFERRED EMBODIMENT

Figures 1, 2, 5:
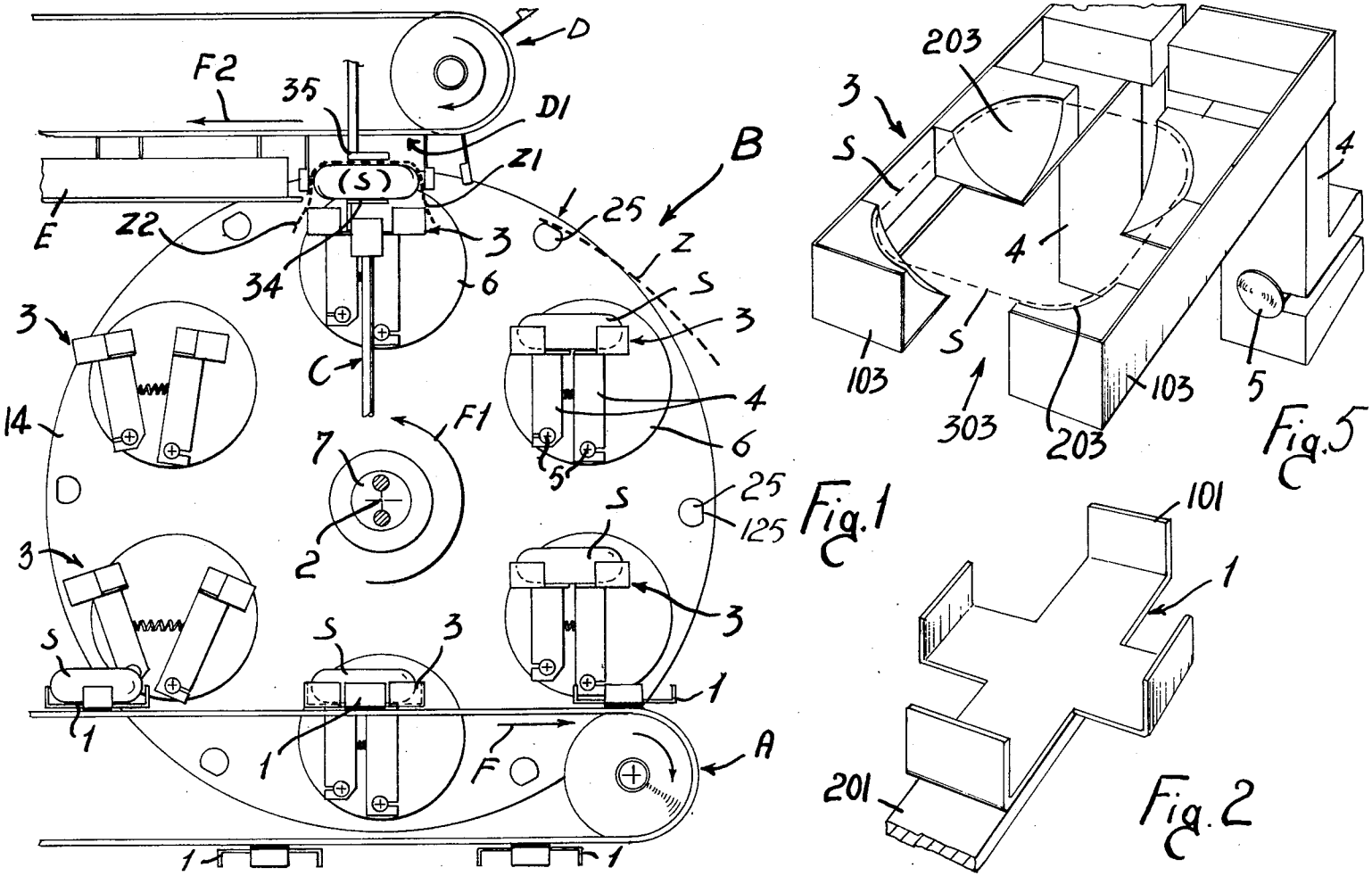
FIG. 1 shows in front elevation and semi-diagrammatic manner the three conveyors forming part of the apparatus
FIG. 2 shows in perspective view one of the containers carried by the rectilinear conveyor for feeding the soap bars.
FIG. 5 shows in perspective view one of the composite cradles or containers provided circumferentially on the turntable conveyor.

In FIG. 1 letter A indicates the horizontal chain conveyor which travels with its upper run in the direction of arrow F, carrying the soap bars S, to be wrapped, in horizontal direction, with the required constant positioning, and at a correct distance from one another. Letter B indicates the turntable conveyor which takes in correct time relationship the soap bars from the conveyor A and by rotating in the direction of arrow F1 carries the said soap bars at its upper or top section, together with the wrapper Z, in correspondence with elevating and transferring means C which, in correct time relationship, transfer the whole assembly inside one of the carrier sections of a rectilinear chain conveyor D arranged horizontally and travelling with its lower run in the direction of arrow F2. Conveyor D inserts the soap bars and wrapper into a known type apparatus E which completes and seals the wrapping.

Figure 3:
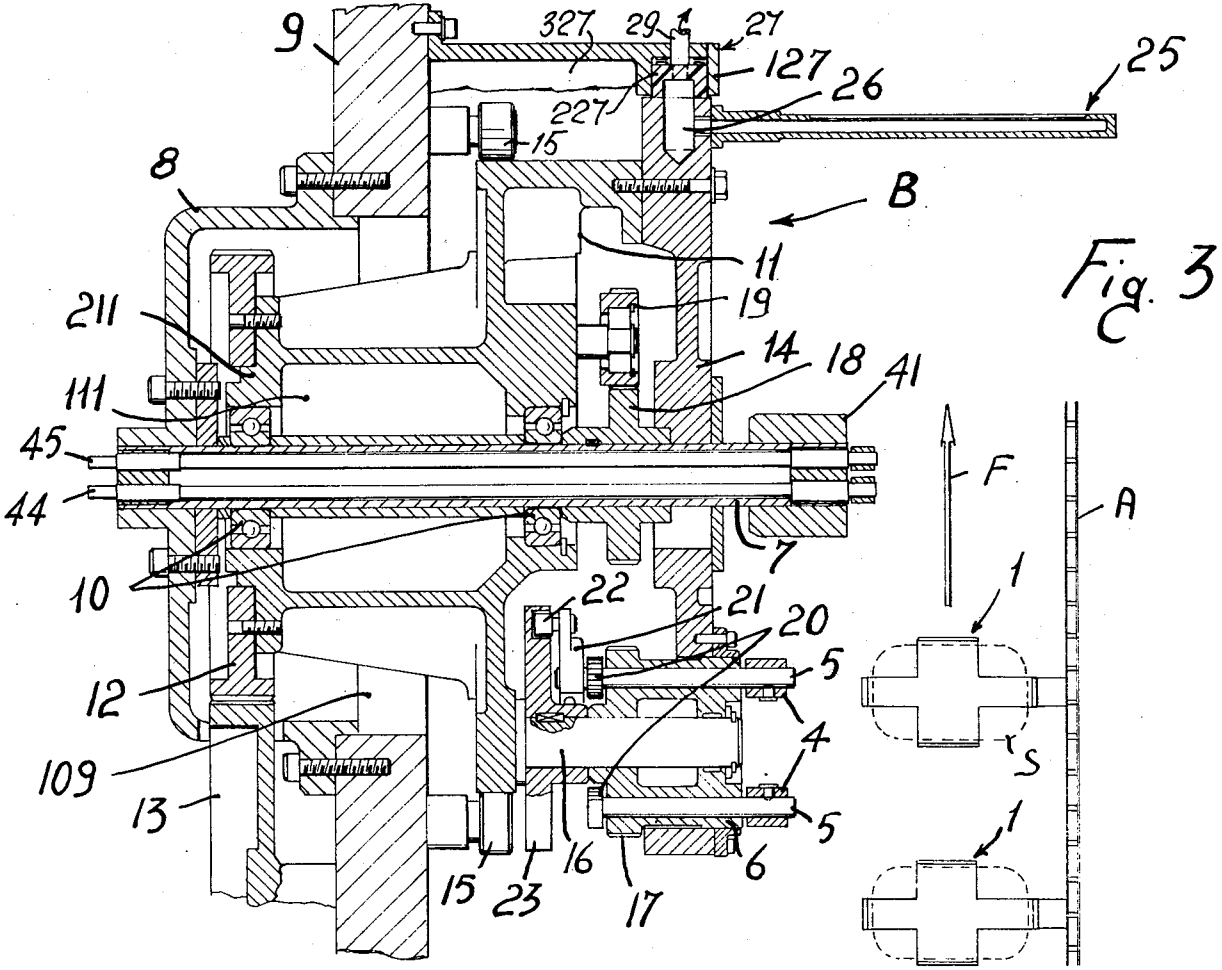
FIG. 3 shows, in plan view and in section along the axis of rotation, the turntable conveyor which connects the two rectilinear conveyors.

In the described assembly, a first improvement has been made to the rectilinear conveyor A, and more particularly to its containers 1 which are intended for the positioned transfer of the soap bars. With reference also to FIGS. 2 and 3 it is noted that the containers have in plan substantially a cross-like shape with the extremities 101 lifted upwardly, so as to leave free substantial portions of the peripheral zones, in the present case the corner zones, of the soap bar S carried with the minimum side clearance by each one of said containers. If the soap bar presents a rectangular shape, with more or less rounded edges or corners, the containers 1 are positioned with their longitudinal axes at right angles with respect to the chain of conveyor A (see also FIG. 3). By means of suitable brackets 201 the containers are supported horizontally, suitably equispaced from one another, projecting sidewise as above mentioned on a side of the conveyor A. The upper run of conveyor A comes to be positioned, with its end section, as a horizontal chord with respect to a small lower arc section of the turntable conveyor B which rotates about axis 2 which is positioned horizontally and at right angles with respect to said conveyor A. The containers 1 of conveyor A are directed towards the turntable conveyor (see FIG. 3) and are positioned at a suitable distance from same.

On turntable conveyor B there are circumferentially mounted, in a suitable number and angularly equispaced, the composite cradles 3, which are constantly maintained in the horizontal position. As will appear from FIG. 5, the cradles 3 consist of two opposed, equal and parallel sections or halves 103, shaped in their upper portion as indicated at 203 for supporting the rounded corner zones of the soap bar, and defining, in their closed position as shown in FIG. 5, an intermediate opening 303 which presents in plan the same cross-like shape as the containers 1 of the conveyor A. The two sections or halves of each cradle 3 are supported by supporting legs which are keyed onto respective horizontal and parallel pins 5 which are supported by a small cylinder-like element 6 which is rotatably mounted on the turntable conveyor B with the possibility of performing a correct revolution about the axis of same so as to guarantee, as above mentioned, that the cradles 3 be maintained in a horizontal plane. Upon rotation of the turntable (FIG. 1) the cradles 3 arrive in correspondence with the conveyor A with their sections or halves 103 reciprocally spaced apart, and during their descent, they are passed through by a respective container 1, under which container 1 they position themselves at a lower level. In the subsequent lifting stage, the cradles 3 are again passed through or traversed by the container 1, with which they are in phase coincidence, while their sections or halves 103 are again brought into close proximity, so that the soap bar S is taken off container 1 and lifted towards the wrapper devices. During transfer of the soap bar from container 1 to cradle 3, no relative movement takes place between the said soap bar and the said handling devices, thanks to a correct synchronization between the conveyors A and B, so that the product is safeguarded against a first possibility of becoming scratched.

Referring now to FIG. 3, it is to be noted that the turntable conveyor B comprises a horizontal shaft 7 secured by one of its ends to a cup-like support 8 which in turn is integral with the back side of a plate 9 which forms part of a box-like structure inside which there are housed the various drives for the wrapping machine. Shaft 7 passes through a large opening 109 of plate 9 so that the turntable body, rotatably mounted on said shaft through bearings 10, projects for a suitable distance beyond the front surface of said plate 9. The turntable body comprises a rear end portion 211 which carries axially keyed the toothed crown 12 which gets its drive from the rigid gearing 13 of the machine. It comprises further an intermediate portion 111, and a front drum 11 which is closed by the circular platform 14.

Drum 11 is also supported by idle rollers 15 provided on the front side of plate 9. On the circular platform 14 there are rotatably mounted the aforementioned cylindrical elements or cylinders 6, each carried by a respective pin 16 which is integral with the forward section of drum 11. Cylinders 16 are not axially shiftable, and are provided at their rear section with a coaxial toothed crown 17, said toothed crown having pitch diameter and number of teeth equal to those of a toothed wheel 18 keyed onto shaft 7, at the interior of drum 11. The wheels 17 and 18 are co-planar, and for each wheel 17 there is provided on drum 11 an idle toothed wheel 19 which connects same to fixed wheel 18. From FIG. 4 it appears evident that, since wheels or gears 17 and 18 are equal and wheels or gears 19 serve merely as connecting gears, the preferred angular position for each cradle 3 carried by a cylinder 6 is not modified by rotation of the turn-table, in consideration of the fact that a certain angle of counterclockwise rotation of the said turntable corresponds to an equal angle of clockwise rotation of cylinders 6, thus assuring that the cradles are maintained in the position established at the original keying onto pins 5, of their supporting legs 4.

Figure 6:
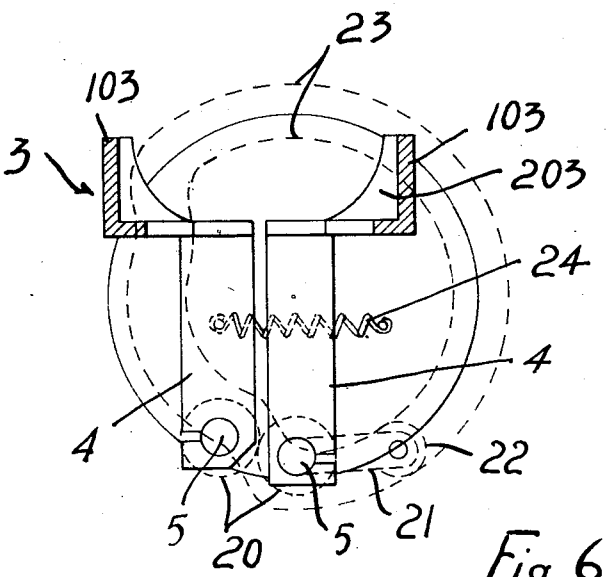
FIG. 6 shows in front elevation and with parts in section the cradle according to FIG. 5.

From FIGS. 3 and 6, it appears that pins 5 project from the rear end of the respective cylinder 6 and are connected by means of toothed sectors 20 such that rotation of one pin in one direction corresponds to simultaneous rotation of the other pin in the other direction. One of pins 5, with the said end projecting out of the rear section of cylinder 6, carries keyed thereonto a lever 21 which is provided with a cam follower roller 22 which follows the path of a double-action annular cam 23, keyed onto pin 16. On the front section of cylinder 6, a spring 24 urges any one of the supporting legs of the cradle sections 103 to take up any slack existing between the toothed sectors 20 and the cam follower roller 22 and cam 23. During the rotation of the turntable, a relative rotary movement is initiated between cylinders 6 and the respective cams 23, so that cradles 3 are controlled to the desired opening (spaced apart) or closure movements. It is preferable that the cradles be closed during the arc of revolution from the lower to the upper section of turntable conveyor B, and opened for the remaining arc of 180°.

Before describing the means for transferring the soap bars from the cradles 3 to the wrapping conveyor D, there will now be described the means, carried by turntable conveyor B, for taking and correctly positioning the wrapping sheets onto each cradle 3.

Figure 4:
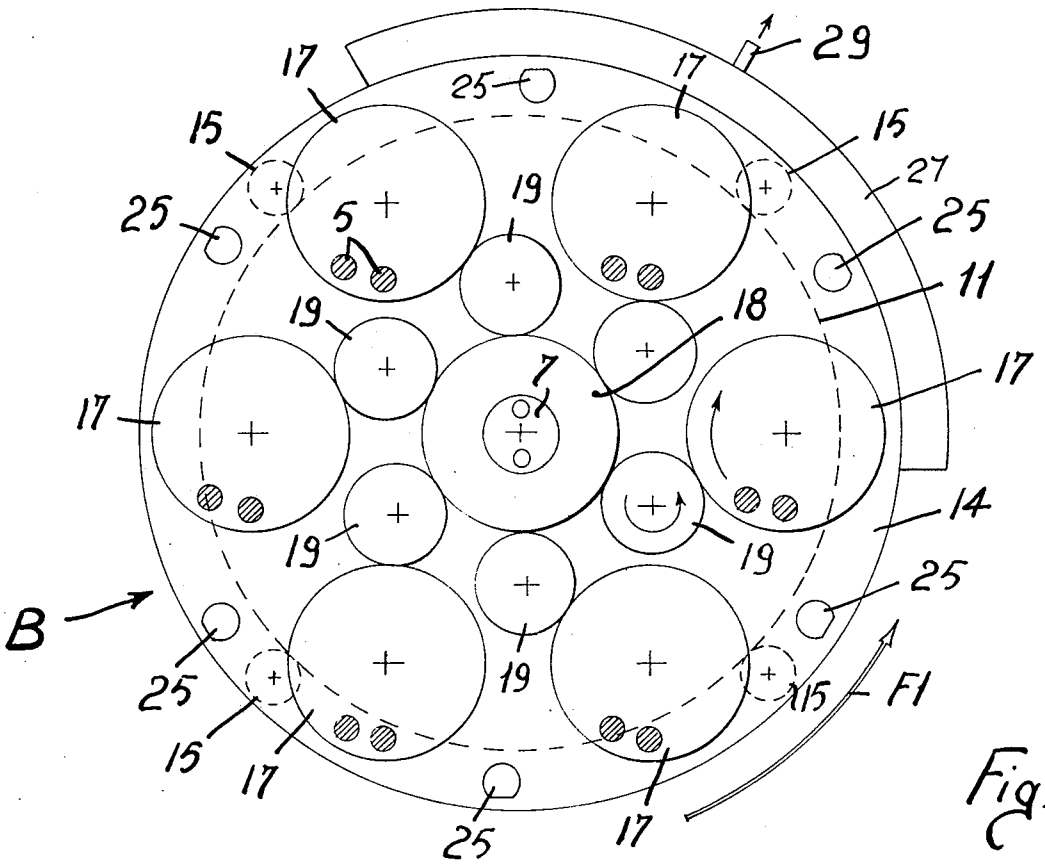
FIG. 4 shows diagrammatically in front elevation the inner gear trains of the turntable conveyor.

As shown in FIGS. 1, 3 and 4, upstream (in the direction of rotation) of each cradle 3 on the front surface of turntable, there project out, one for each cradle 3, suitable horizontal hollow rods 25, connected through a respective duct 26 which opens on the circumference of platform 14, into an arc-shaped distribution chamber 27 secured to the wall plate 9 of the machine. As is more particularly illustrated in FIG. 3, the distribution chamber is formed by a supporting outer member 127 having an inverted "U" section which serves as a guide for the underlying sector 227 made of material having a low coefficient of friction, also presenting an inverted "U" section, closed at its extremities and urged by elastic means 28 so as to adhere against platform 14. A suction duct 29 is connected to the grooved sector 227.

The outer member 127 forms part of a circular body which intersects platform 14 along its whole circumference, so as to form, together with a tubular body 327, a bell-like member which laterally envelopes the front section of turntable conveyor B and connects same with a tight seal to the side plate 9, so as to keep at the interior of the turntable itself the gear lubricant.

Each rod 25 presents, directed towards the exterior of the turntable, a longitudinal flattened portion 125 having a longitudinal groove 225 which is provided at its bottom with suitably spaced suction bores 30.

Figure 7:
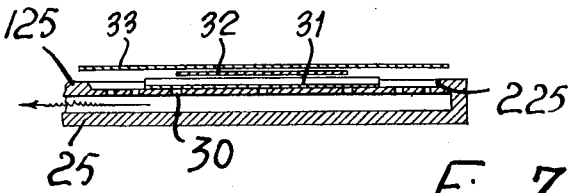
FIG. 7 shows in longitudinal section one of the suction rods provided on the turntable conveyor, for taking the wrapper and for correctly positioning same onto the soap bar to be wrapped.

Thanks to the presence of groove 225 the rod 25 is capable of taking by one of their ends even three superposed sheets of paper 31, 32 and 33 (FIG. 7) the intermediate one 32 of which has a width even smaller than that of lower sheet 31. Since, if the wrapper is formed by three sheets, the lower sheet 31 is usually made of thin tissue paper, or at least extremely pliable paper, it will happen that the said sheet, along a transverse section, internally covers a portion of groove 225 so that suction exerted by the bores 30, which remain unobstructed, is present inside groove 225 and thus holds fast on the rod also the second and the third sheet. Of course, the length of the groove 225 is less than the width of the wrapper sheets.

Looking now at FIG. 1, it is to be noted that the wrapper Z is held to rods 25 by suitable means (not shown) whenever the rods 25 are about to reach the upper section of the turntable, i.e., whenever each rod comes to be located above the respective cradle 3 containing the soap bar to be wrapped. When cradle 3 reaches the upper section of the turntable, the rod 25 carrying the wrapper is positioned in advance with respect to the cradle, and substantially on the same plane, so that the wrapper Z comes to be laid upon the soap bar contained in the said cradle.

Whenever a cradle 3 reaches the upper section of the turntable conveyor B, the soap bar contained in said cradle, together with the wrapper Z positioned on it and which has been abandoned in correct time relationship by the rod 25, is gripped between two vertical gripper members 34 and 35 which in correct time relationship lift the whole, in combination with a simultaneous transferring movement, in the direction of rotation of the turntable, so that the soap bar and wrapper are transferred inside a carrier section D1 of the wrapper conveyor D, thereby obviating harmful relative movement between the product and the handling devices.

Simultaneously, means not shown are provided for folding the trailing edge Z1 of the wrapper Z, so that when the assembly is inserted inside the fixed guide E, wrapping of the product is completed by the subsequent folding of the leading edge Z2 and closure of the sides of the thus obtained tubular wrapper. The guide E and the conveyor D are of known type and therefore a detailed description of same can be omitted.

Subsequently, the grippers 34 and 35 are again spaced apart with reciprocal movement back to their initial position, while the emptied cradle 3, with its sections 103 already opened, returns downwardly for the repetition of the working cycle. The lower gripper 34 (see also FIG. 8) has a shape such as to be able to pass easily through the transversal portion of the opening existing between the sections 103 of each cradle. Said gripper 34 is carried by a vertical rod 36 which is integral with a supporting member 37, which, through another rod 38 which is parallel to the first mentioned rod, is capable of vertically sliding on a slide 39 which in turn is movable on guide rods 40 which are secured to a support 41 fixed at the extremity of shaft 7 projecting out of the front surface of platform 14 (FIG. 3).

Figure 8:
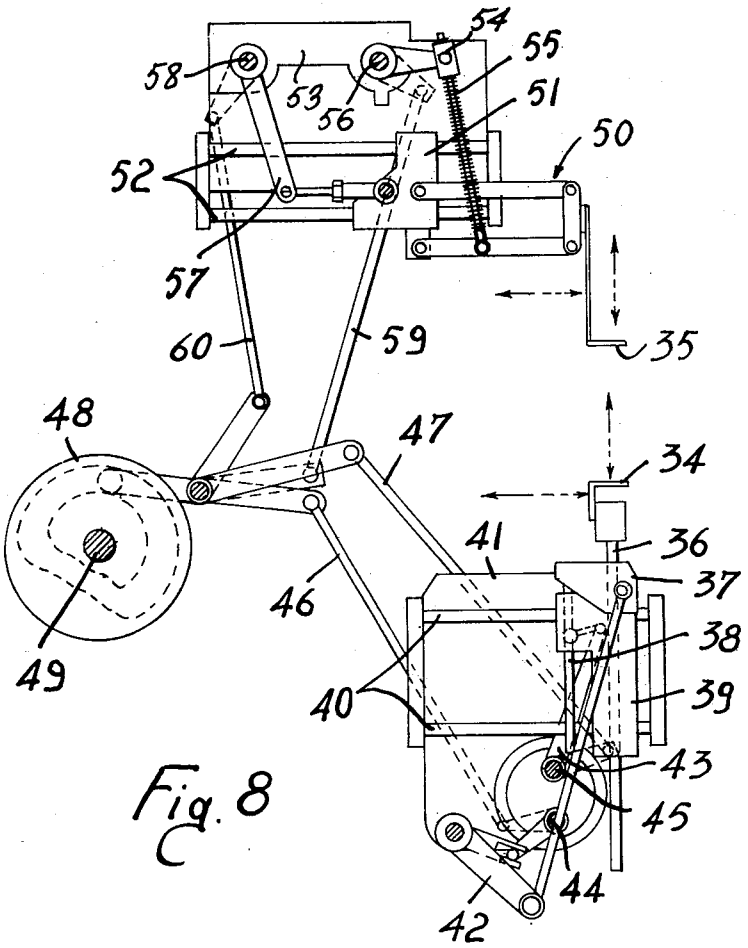
FIG. 8 shows in front elevation the means for transferring in correct time relationship the soap bars and wrappers from the turntable conveyor to the last rectilinear conveyor for the wrapping.

The actuation of the lower gripper takes place by means of two-lever system 42, 43, connected respectively to the support 37 and to the slide 39, and by the other ends to two small shafts 44 and 45 which longitudinally traverse the turntable shaft 7, projecting out of the rear end of same to be connected to further lever systems 46, 47 which get their motion from respective cams 48 (one of which is illustrated in FIG. 8) keyed in phase relationship onto the shaft 49, suitably synchronized with the conveyors A, B and D.

The upper gripper 35 is instead connected to the vertical side of a parallelogram 50 which is articulated, with horizontal axis, to a slide 51 which forms the fourth vertical side of said parallelogram. The slide 51 is movable horizontally on guide rods 52 mounted on a support 53 which is secured to the wall plate of the machine. To one of the movable sides of the parallelogram there is connected a lever 54, with interposed spring 55, and said lever 54 is connected to a horizontal pin 56 from which it gets its motion. Thanks to spring 55 the grippers grip the soap bar in a delicate manner and so as to facilitate high speeds of transfer. The slide for the horizontal displacements of the upper gripper is instead connected to a lever system 57 which gets its drive from horizontal pin 58. The pins 56 and 58, which are rotatably carried by supporting member 53, get their drive from levers 59 and 60 which are operatively connected to respective cams keyed onto the driving shaft 49.

What is claimed is:

1. Apparatus for transferring pieces to be wrapped from a lower feed conveyor to an upper wrapping conveyor, comprising:

a. a lower horizontal rectilinear feed conveyor carrying a plurality of equidistantly spaced containers presenting an open top and a plan section such as to leave free substantial portions of the peripheral zones of the piece to be wrapped;

b. an intermediate rotatable turntable conveyor having its axis of rotation horizontal and orthogonal with respect to the said lower feed conveyor which latter comes to be positioned as a horizontal chord with respect to a lower arc section of said turntable conveyor;

c. a plurality of composite cradles mounted on said turntable conveyor and equidistantly spaced around a pitch circle common thereto so as to describe a circular path upon rotation of the turntable, each composite cradle consisting of at least two opposed sections presenting upper support surfaces for the free peripheral zones of the piece to be wrapped, said cradle sections being arranged to be spaced apart or opened so as to permit the passage therethrough of a container of the lower conveyor carrying a piece to be wrapped, and to be closed together so as to present between them an opening permitting the passage therethrough of the said container of the lower conveyor and so as to be capable to engage by their said upper support surfaces the free peripheral zones of the piece to be wrapped;

d. means for controlling the said opening and closure of the said composite cradle sections so that upon rotation of the turntable conveyor the cradle sections are opened during the descent movement towards the lower feed conveyor, are closed after having passed the point of intersection of their descent path with the rectilinear path of the said lower conveyor, in such a manner that they are traversed in their said open position by a container of said lower conveyor carrying a piece, and are lifted in their closed position, while carrying the piece taken from the container, at least until they reach substantially the upper point of their circular path; and e. gripper means, arranged substantially in correspondence with the upper point of the circular path of the composite cradles, arranged to grip the piece carried by each cradle so as to lift it out of said cradle and insert it into an upper wrapping conveyor.

2. Apparatus according to claim 1, further comprising, at least one suction device for each cradle mounted on said turntable conveyor in correspondence with each composite cradle and in advance of it considering the direction of rotation of the turntable, said suction device being adapted to pick a wrapper from any suitable dispenser and position said wrapper onto the piece carried by the cradle, whereby the piece is inserted in the said wrapping conveyor together with its wrapper.

3. Apparatus according to claim 1, in which each container of the lower conveyor presents in plan a cross-like section, and each composite cradle of the turntable conveyor presents between its sections, when in closed positioned, a substantially similar cross-like opening, the upper support surfaces of the composite cradle sections being arranged so as to complementarily engage the empty corner zones between the bars of the cross.

4. Apparatus according to claim 3, in which the cradle sections of each composite cradle are mounted on cylinder-like members rotatably mounted on the turntable conveyor and controlled in their rotation through a suitable planetary gear train, so as to maintain a constant parallelism of the support surfaces of the closed cradle sections upon rotation of the turntable conveyor, cam follower elements being associated with each cradle section and engaging corresponding relatively fixed cam surfaces so that, upon rotation of the turntable, and consequent rotation of the cradle-carrying cylinders, the cradle sections are suitably controlled as to their opening or closure position.

5. Apparatus according to claim 1, in which the gripper means for lifting the piece out of the cradle and inserting it into the upper wrapping conveyor consists of two superposed gripper elements which are arranged to move vertically to and fro with respect to one another, and horizontally in the same direction of the upper conveyor, so as to grip between them the piece carried by the cradle, lift it out of the cradle and insert it into said upper conveyor, the lower gripper having a shape permitting its passage through the opening existing between the closed sections of each cradle.

6. Apparatus according to claim 5, in which the gripper elements are mounted on rods which are movable vertically on slides horizontally movable, the relative movements of said rods and slides being controlled through lever systems operated upon rotation of the turntable conveyor.

* * * * *